US009578719B2

(12) United States Patent
Han et al.

(10) Patent No.: US 9,578,719 B2
(45) Date of Patent: Feb. 21, 2017

(54) METHOD AND DEVICE FOR CORRECTING COLOR SHIFT OF ORGANIC LIGHT-EMITTING DIODE (OLED) DISPLAY PANEL, AND DISPLAY DEVICE

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Yuebai Han, Beijing (CN); Weilin Lai, Beijing (CN); Xinxin Jin, Beijing (CN); Minghua Xuan, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 0 days.

(21) Appl. No.: 14/894,453

(22) PCT Filed: Jul. 16, 2015

(86) PCT No.: PCT/CN2015/084175

§ 371 (c)(1),
(2) Date: Nov. 27, 2015

(87) PCT Pub. No.: WO2016/112668

PCT Pub. Date: Jul. 21, 2016

(65) Prior Publication Data

US 2016/0366747 A1 Dec. 15, 2016

(30) Foreign Application Priority Data

Jan. 15, 2015 (CN) ..... 2015 1 0020929

(51) Int. Cl.
*H05B 33/10* (2006.01)

(52) U.S. Cl.
CPC ..... *H05B 33/10* (2013.01)

(58) Field of Classification Search
CPC ..... H01J 9/42; H01J 9/44; H01K 1/60; H05B 33/10
See application file for complete search history.

(56) References Cited

U.S. PATENT DOCUMENTS

2005/0184937 A1* 8/2005 Lee ..... G09G 3/3225 345/82
2007/0221867 A1* 9/2007 Beeson ..... H05B 33/10 250/487.1

(Continued)

FOREIGN PATENT DOCUMENTS

CN 101452668 A 6/2009
CN 103886829 A 6/2014
CN 104505029 A 4/2015

OTHER PUBLICATIONS

English machine translation of CN101452668A.*

(Continued)

*Primary Examiner* — Anne Hines
(74) *Attorney, Agent, or Firm* — Ladas & Parry LLP

(57) ABSTRACT

A method and device for correcting a color shift of an OLED display panel, and a display device are disclosed. The method includes: performing an ageing treatment on the monochromatic luminescent devices in the OLED display panel; performing a luminescent lifetime attenuation test on the monochromatic luminescent devices after the ageing treatment respectively, and obtaining corresponding luminescent lifetime attenuation rates of the monochromatic luminescent devices; and performing an ageing treatment on the monochromatic luminescent device with rapidest luminescent lifetime attenuation rate again when differences between the luminescent lifetime attenuation rates of the monochromatic luminescent devices are greater than a pre- (Continued)

set threshold, until differences between the luminescent lifetime attenuation rates of the monochromatic luminescent devices are less than the preset threshold. The method effectively corrects the color shift phenomenon of display images of an OLED display product after long-term use.

20 Claims, 3 Drawing Sheets

(56) References Cited

U.S. PATENT DOCUMENTS

| | | | | |
|---|---|---|---|---|
| 2008/0048951 | A1 | 2/2008 | Naugler, Jr. et al. | |
| 2008/0057818 | A1* | 3/2008 | Ogawa ..... | H05B 33/10 445/3 |
| 2013/0002960 | A1 | 1/2013 | Ryu et al. | |

OTHER PUBLICATIONS

English machine translation of CN103886829A.*
English machine translation of CN104505029A.*
International Search Report and Written Opinion both dated Sep. 23, 2015; PCT/CN2015/084175.

* cited by examiner

METHOD AND DEVICE FOR CORRECTING COLOR SHIFT OF ORGANIC LIGHT-EMITTING DIODE (OLED) DISPLAY PANEL, AND DISPLAY DEVICE

TECHNICAL FIELD

Embodiments of the present invention relate to a method and device for correcting a color shift of an organic light-emitting diode (OLED) display panel, and a display device.

BACKGROUND

Along with the development of display technology, the requirements of consumers on audio-video products are higher and higher. As for display manufacturers, the production of displays with high resolution and high image quality is the developing direction. OLED has been widely applied in displays due to the characteristics of self-luminescence, high brightness, wide viewing angle, rapid response, the capability of forming red, green and blue (RGB) full-color components, etc. Currently, the application of OLED display panels has entered the practical stage. Automobile audios and mobile phones on the market have employed the OLED display panels. In the future, the OLED display panel will be widely applied in light and thin displays such as mobile products, notebook computers, monitors and wall hung TVs. Moreover, the full-color development will enhance the competitiveness of OLED products.

Along with the full-color technical development of OLEDs, the currently common full-color technology includes fine-metal-mask (FMM) vacuum vaporization method, white+color filter (W+CF) method, blue+color conversion (Blue+CCM) method, etc. Wherein, FMM is the mainstream technology of the current small and medium size OLED display products. But the OLED display product has a relatively serious problem: the lifetime of organic materials of an emission layer (EML) in an OLED device is different along with the degree of attenuation of time, and hence images displayed by the display will have the problem of color shift. OLED display products manufactured by the FMM method are particularly more obvious, and the lifetime attenuation of RGB organic materials of the OLED display product is different. The attenuation rate of blue (B) organic materials is the rapidest ($LT(R) \geq LT(G) >> LT(B)$). As illustrated in FIG. 1, the lifetime attenuation of B organic materials is relatively rapid and the lifetime attenuation of red (R) organic materials is relatively slow. Therefore, in images displayed by the OLED display product after long-term use, the brightness of B is lower and the brightness of R is higher, and hence the color shift phenomenon tends to occur. As illustrated in FIG. 2, the color of the images displayed by the OLED display product will shift along the direction represented by an arrow. In addition, the brightness of the OLED device is quickly reduced in the early stage service. As illustrated in FIG. 1, along with the rise of the use time, the attenuation of the brightness of RGB luminescent devices will be more and more moderate, but the attenuation of the brightness of the RGB luminescent devices in the early stage service is relatively rapid and nonuniform. In this case, the images displayed by the OLED display product tend to encounter afterimage problems.

SUMMARY

The embodiment of the present invention provides a method for correcting a color shift of an OLED display panel, which comprises: performing ageing treatment on monochromatic luminescent devices in the OLED display panel; performing a luminescent lifetime attenuation test on monochromatic luminescent devices after the ageing treatment respectively, and obtaining corresponding luminescent lifetime attenuation rates of the monochromatic luminescent devices; and performing an ageing treatment on the monochromatic luminescent device with rapidest luminescent lifetime attenuation rate again when differences between the luminescent lifetime attenuation rates of the monochromatic luminescent devices are greater than a preset threshold, until the differences between the luminescent lifetime attenuation rates of the monochromatic luminescent devices are less than the preset threshold.

In one embodiment of the present invention, the step of performing an ageing treatment on the monochromatic luminescent devices in the OLED display panel includes: inputting a different preset voltage into monochromatic luminescent devices in the OLED display panel respectively, and allowing the monochromatic luminescent devices to emit light for a preset duration and subsequently be cooled to room temperature, in which the preset voltage is determined by materials of emitting layers of the monochromatic luminescent devices.

In one embodiment of the present invention, the step of performing a luminescent lifetime attenuation test on monochromatic luminescent devices after the ageing treatment respectively includes: inputting voltage for luminescent lifetime attenuation tests into the monochromatic luminescent devices after the ageing treatment in sequence, allowing the monochromatic luminescent devices to emit light for preset duration, and obtaining a corresponding luminescent lifetime attenuation curve of the monochromatic luminescent devices.

In one embodiment of the present invention, the preset voltage inputted in the process of performing the ageing treatment on monochromatic luminescent devices in the OLED display panel is greater than the voltage inputted in the process of performing a luminescent lifetime attenuation test on the monochromatic luminescent devices after the ageing treatment.

In one embodiment of the present invention, a difference between a cathode voltage and an anode voltage loaded to the monochromatic luminescent devices in the process of performing the ageing treatment on the monochromatic luminescent devices in the OLED display panel is greater than a difference between a cathode voltage and an anode voltage loaded to the monochromatic luminescent devices in the process of performing a luminescent lifetime attenuation test on the monochromatic luminescent devices after the ageing treatment.

In one embodiment of the present invention, in the process of performing the ageing treatment on the monochromatic luminescent devices in the OLED display panel, the cathode voltages loaded to the monochromatic luminescent devices are the same and the anode voltages loaded to the monochromatic luminescent devices are the same.

In one embodiment of the present invention, in the process of performing the ageing treatment by inputting the preset voltage into the monochromatic luminescent devices in the OLED display panel, the preset duration of the light emitting of the monochromatic luminescent devices are the same.

The embodiment of the present invention further provides a device for correcting a color shift of an OLED display panel, which comprises: an ageing treatment unit, a test unit and a processing unit, in which the ageing treatment unit is configured to perform ageing treatments on monochromatic luminescent devices in the OLED display panel; the test unit is configured to perform a luminescent lifetime attenuation test on the monochromatic luminescent devices after the ageing treatment, and obtain corresponding luminescent lifetime attenuation rates of the monochromatic luminescent devices; and the processing unit is configured to perform an ageing treatment on the monochromatic luminescent devices with rapidest luminescent lifetime attenuation rate again when differences between the luminescent lifetime attenuation rates of the monochromatic luminescent devices are greater than a preset threshold, until the differences between the luminescent lifetime attenuation rates of the monochromatic luminescent devices are less than the preset threshold.

In one embodiment of the present invention, the ageing treatment unit is configured to input a different preset voltage into the monochromatic luminescent devices in the OLED display panel respectively, and allow the monochromatic luminescent devices to emit light for a preset duration and subsequently be cooled to room temperature, in which the preset voltage is determined by materials of emitting layers of the monochromatic luminescent devices.

In one embodiment of the present invention, the test unit is configured to input voltage for luminescent lifetime attenuation tests into the monochromatic luminescent devices after the ageing treatment in sequence, allow the monochromatic luminescent devices to emit light for a preset duration, and obtain a corresponding luminescent lifetime attenuation curve of the monochromatic luminescent devices.

In one embodiment of the present invention, the ageing treatment unit is configured as: the preset voltage inputted in the process of performing the ageing treatment on the monochromatic luminescent devices in the OLED display panel is greater than the voltage inputted in the process of performing a luminescent lifetime attenuation test on the monochromatic luminescent devices after the ageing treatment.

In one embodiment of the present invention, the ageing treatment unit is configured as: differences between cathode voltages and anode voltages loaded to the monochromatic luminescent devices in the process of performing the ageing treatment on the monochromatic luminescent devices in the OLED display panel are greater than differences between cathode voltages and anode voltages loaded to the monochromatic luminescent devices in the process of performing a luminescent lifetime attenuation test on the monochromatic luminescent devices after the ageing treatment.

In one embodiment of the present invention, in the process of performing the ageing treatment on the monochromatic luminescent devices in the OLED display panel, the cathode voltages loaded to the monochromatic luminescent devices are the same and the anode voltages loaded to the monochromatic luminescent devices are the same.

In one embodiment of the present invention, in the process of performing the ageing treatment by inputting the preset voltage into the monochromatic luminescent devices in the OLED display panel, the preset duration of light emitting of the monochromatic luminescent devices are the same.

The embodiment of the present invention further provides an OLED display device, which comprises the OLED display panel processed by the above method.

BRIEF DESCRIPTION OF THE DRAWINGS

Simple description will be given below to the accompanying drawings of the embodiments to provide a more clear understanding of the technical proposals of the embodiments of the present invention. Obviously, the drawings described below only involve some embodiments of the present invention but are not intended to limit the present invention.

DETAILED DESCRIPTION

For more clear understanding of the objectives, technical proposals and advantages of the embodiments of the present invention, clear and complete description will be given below to the technical proposals of the embodiments of the present invention with reference to the accompanying drawings of the embodiments of the present invention. Obviously, the preferred embodiments are only partial embodiments of the present invention but not all the embodiments. All the other embodiments obtained by those skilled in the art without creative efforts on the basis of the embodiments of the present invention illustrated shall fall within the scope of protection of the present invention.

The inventors have noted that the problem to be solved by those skilled in the art is how to solve the problems of afterimage in the early stage service and color shift of display images after long-term use of OLED display products.

Detailed description will be given below to the preferred embodiments of the method and the device for correcting a color shift of the OLED display panel, and the display device, provided by the embodiment of the present invention, with reference to the accompanying drawings.

Figure 1:
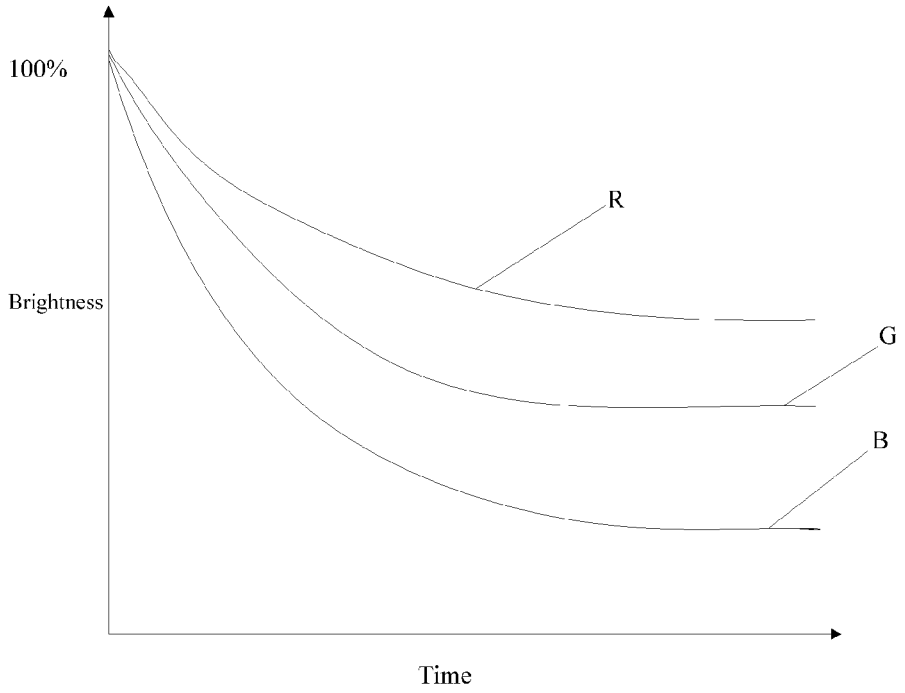
FIG. 1 is a schematic diagram illustrating the attenuation of the brightness of the three primary colors (red, green and blue, RGB) in the prior art.
Figure 2:
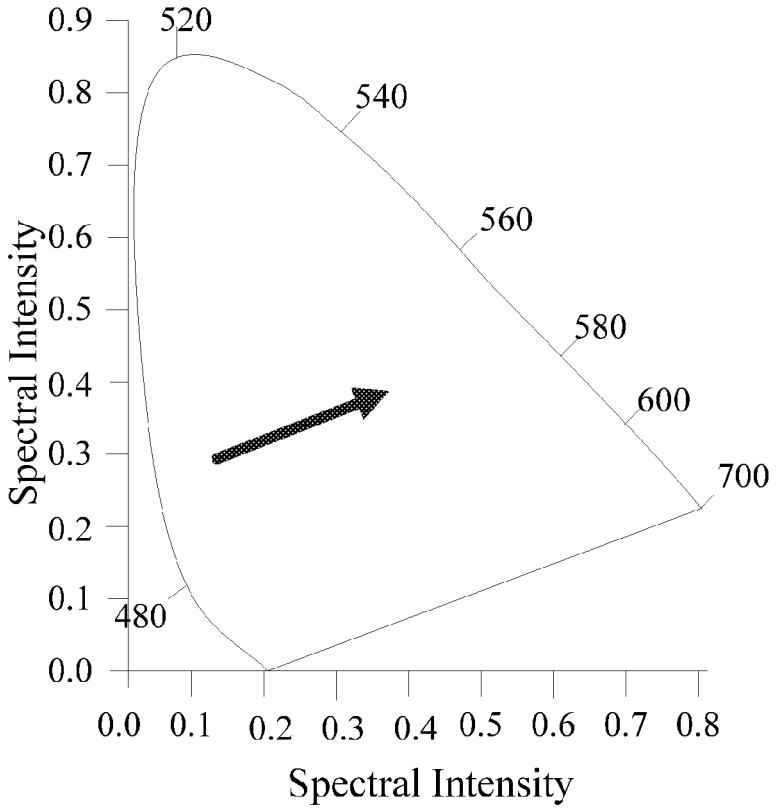
FIG. 2 is a schematic diagram illustrating a color shift of a display image of an OLED display product in the prior art.
Figure 3:
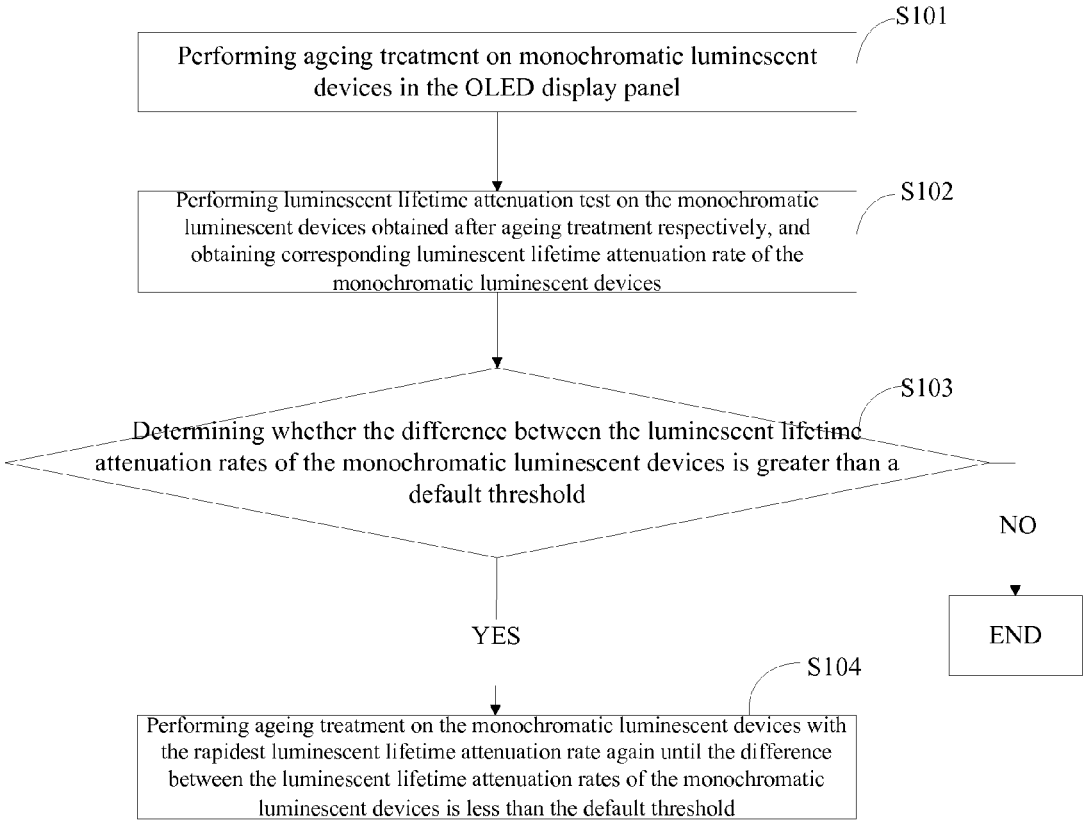
FIG. 3 is a flowchart illustrating the process of performing the ageing treatment on an OLED display panel in one embodiment of the present invention.

The embodiment of the present invention provides a method for correcting a color shift of an OLED display panel, which, as illustrated in FIG. 3, may specifically comprise the following steps:

S101: performing ageing treatment on monochromatic luminescent devices in the OLED display panel;

S102: performing a luminescent lifetime attenuation test on the monochromatic luminescent devices after the ageing treatment respectively, and obtaining corresponding luminescent lifetime attenuation rates of the monochromatic luminescent devices;

S103: determining whether differences between the luminescent lifetime attenuation rates of the monochromatic luminescent devices are greater than a preset threshold, executing step S104 if so, and ending the process if not; and

S104: performing an ageing treatment on the monochromatic luminescent devices with rapidest luminescent lifetime attenuation rate again when differences between the luminescent lifetime attenuation rates of the monochromatic luminescent devices are greater than the preset threshold, until differences between the luminescent lifetime attenuation rates of the monochromatic luminescent devices are less than the preset threshold.

In the method for correcting a color shift of the OLED display panel provided by the embodiment of the present invention, the monochromatic luminescent devices in the OLED display panel are subjected to ageing treatments; luminescent lifetime attenuation tests are performed on the monochromatic luminescent devices after the ageing treatments respectively, and corresponding luminescent lifetime attenuation rates of the monochromatic luminescent devices are obtained; and the monochromatic luminescent device with rapidest luminescent lifetime attenuation rate is subjected to ageing treatments again when differences between the luminescent lifetime attenuation rates of the monochromatic luminescent devices are greater than the preset threshold, until differences between the luminescent lifetime attenuation rates of the monochromatic luminescent devices are less than the preset threshold. In the OLED display panel processed by the processing method, as the early stage service life of the monochromatic luminescent devices is rapidly consumed, the problem of afterimage of the OLED display panel in the early stage service is solved. Meanwhile, the lifetime attenuation rates of the processed monochromatic luminescent devices are moderate and become consistent. Therefore, as the relative brightness of the monochromatic luminescent devices become consistent along with the rise of the use time, the color shift phenomenon of display images of the OLED display product after long-term use can be effectively avoided.

It should be noted that the method for correcting a color shift of the OLED display panel provided by the embodiment of the present invention can be applied in full-color OLED display panels comprising monochromatic luminescent devices of various colors. No limitation will be given to the color of the monochromatic luminescent devices. For the convenience of description, description is given in the following embodiments by taking the case that the OLED display panel only comprises monochromatic luminescent devices of red, green and blue (RGB) colors as an example.

Figure 4:
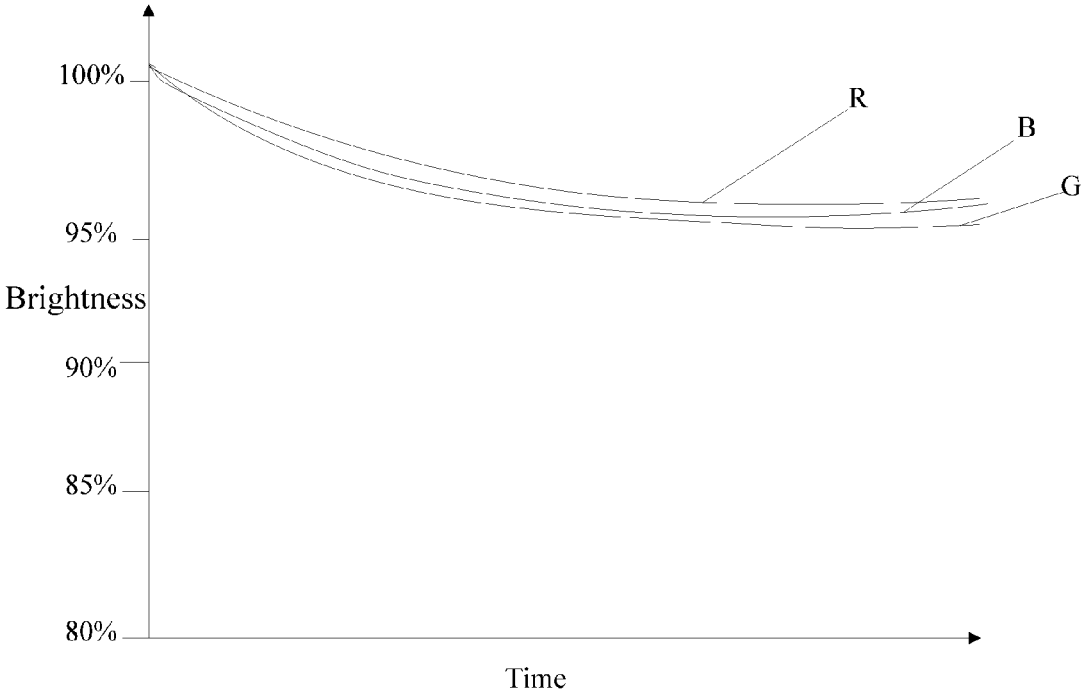
FIG. 4 is a schematic diagram illustrating the attenuation of the brightness of the three primary colors (red, green and blue, RGB) after the ageing treatments of the OLED display panel in one embodiment of the present invention.

For instance, the method for correcting a color shift of the OLED display panel provided by the embodiment of the present invention is adopted to process the OLED display panel. In the processed OLED display panel, the lifetime attenuation rates of the RGB monochromatic luminescent devices are shown in FIG. 4. It can be seen from FIG. 4 that: in the OLED display panel after the ageing treatment, the luminescent lifetime attenuation rates of the RGB luminescent devices become consistent. Therefore, the relative brightness of the monochromatic luminescent devices becomes consistent along with the rise of the use time, so that the color shift phenomenon of display images of the OLED display product after long-term use can be avoided, and hence the quality of images displayed by the display panel can be guaranteed.

In specific implementation, in the method provided by the embodiment of the present invention, the implementation of the step S101 may, for instance, includes the following steps: inputting different preset voltages into the monochromatic luminescent devices in the OLED display panel respectively via the ageing treatment unit, and allowing the monochromatic luminescent devices to emit light for a preset duration and subsequently be cooled to room temperature. The preset voltage may control the current flowing across the monochromatic luminescent devices and hence control the luminous intensity of the monochromatic luminescent devices.

The process of performing the ageing treatment on the monochromatic luminescent devices in the OLED display panel may be achieved by means of performing the ageing treatment on all the monochromatic luminescent devices at the same time or may also be achieved by means of performing the ageing treatment on each luminescent device of various colors in sequence. No limitation will be given here.

For instance, in the process of performing the ageing treatment on the monochromatic luminescent devices, because the emitting layers of the monochromatic luminescent devices are made from different materials, the preset voltage for driving the monochromatic luminescent devices to emit light and heat is also different. For instance, the case that the driving voltage of the monochromatic luminescent devices is different from each other in the case of same relative brightness may be determined according to IVL performance curve data of the monochromatic luminescent devices, measured before ageing treatment. Therefore, appropriate input voltage in the process of ageing treatment may be selected for the monochromatic luminescent devices by the comparison of the IVL performance curves of the monochromatic luminescent devices before and after the ageing treatment, so as to ensure that the attenuation of the relative brightness of the monochromatic luminescent devices after the ageing treatment is not too rapid. For instance, through experimental data, the preset voltage of R luminescent devices may be 7.25V; the preset voltage of green (G) luminescent devices may be 8.5V; and the preset voltage of B luminescent devices may be 7.5V. That is to say, the preset voltages for the ageing treatment of the monochromatic luminescent devices are different. The preset voltages for the ageing treatment of the monochromatic luminescent devices may be determined by the materials of the emitting layers of the monochromatic luminescent devices.

Therefore, in the process of performing the ageing treatment on the monochromatic luminescent devices, preset voltages for driving the monochromatic luminescent devices to emit light and heat must be inputted into corresponding luminescent devices of different colors respectively, so that high current, which may reach 100 mA-600 mA, is produced in the monochromatic luminescent devices of the OLED display panel. Therefore, the monochromatic luminescent devices are driven to emit light and heat for a preset duration, and hence the current ageing of the monochromatic luminescent devices can be achieved. As the monochromatic luminescent devices subjected to ageing treatments are driven to emit light and heat by high current, the monochromatic luminescent devices subjected to current ageing must be naturally cooled to room temperature, so as to avoid the influence on the subsequent luminescent lifetime attenuation test performed on the monochromatic devices subjected to ageing treatment.

In the method provided by the embodiment of the present invention, in the process of performing ageing treatment by inputting the preset voltages into the monochromatic luminescent devices in the OLED display panel, the preset duration of the light emitting of the monochromatic luminescent devices may be same or may also be different. No limitation will be given here. In the process of performing the ageing treatment on the monochromatic luminescent devices in the OLED display panel, the preset duration of the light emitting of the monochromatic luminescent devices may be set to be same. The preset duration thereof may, for instance, be set to about 30 min. The monochromatic luminescent devices in the OLED display panel are controlled to be subjected to ageing treatments at the same time, so that the rapid ageing of the OLED display panel can be conveniently achieved.

In the method provided by the embodiment of the present invention, the implementation of the step S102 may be implemented by, for instance, the following implementation: inputting voltage for luminescent lifetime attenuation tests into the monochromatic luminescent devices after the ageing treatment in sequence, allowing the monochromatic luminescent devices to emit light for a preset duration, and obtaining a corresponding luminescent lifetime attenuation curve of the monochromatic luminescent devices. That is to say, voltage for driving the monochromatic luminescent devices to emit light is inputted and is generally 0-4V; luminescent lifetime attenuation tests are performed on the monochromatic luminescent devices in the OLED display panel in sequence via corresponding luminescent lifetime attenuation test equipment in the environment of constant temperature and humidity; the test duration is, for instance, generally at least 240 hours; and finally, the luminescent lifetime attenuation curves of the monochromatic luminescent devices after the ageing treatment are obtained and provide a more intuitive determining condition for determining whether the luminescent lifetime attenuation rates of the monochromatic luminescent devices in the OLED display panel after the ageing treatment become consistent.

The lifetime attenuation and the brightness attenuation of the monochromatic luminescent devices in the OLED display product in the early stage service are relatively rapid. The attenuation rate is slower along with the rise of the use time. In the method provided by the embodiment of the present invention, the monochromatic luminescent devices in the OLED display panel are subjected to rapid ageing treatment to obtain the OLED display panel in which the attenuation rates of the monochromatic luminescent devices in the OLED display panel in the later use are reduced and become consistent. For instance, the voltage higher than the normal emission driving voltage of the OLED display panel may be inputted, so that high current is produced in the monochromatic luminescent devices of the OLED display panel, and hence the monochromatic luminescent devices are driven to emit light and heat. Therefore, the early stage service life of the monochromatic luminescent devices is rapidly consumed, and hence the ageing treatments can be completed. In the process of performing lifetime attenuation test on the monochromatic luminescent devices in the OLED display panel after the ageing treatment, the lifetime attenuation rate of the monochromatic luminescent devices under normal luminescent state must be tested. Thus, the inputted voltage is the voltage for driving the monochromatic luminescent devices to normally emit light. Therefore, the preset voltage inputted in the process of performing the ageing treatment on the monochromatic luminescent devices in the OLED display panel is greater than the voltage inputted in the process of performing a luminescent lifetime attenuation test on the monochromatic luminescent devices after the ageing treatment.

In the method provided by the embodiment of the present invention, in order to rapidly consume the early stage service life of the monochromatic luminescent devices in the OLED display panel and obtain the OLED display panel in which the attenuation rates of the monochromatic luminescent devices are reduced and become consistent, for instance, differences between cathode voltages and anode voltages loaded to the monochromatic luminescent devices in the process of performing the ageing treatment on the monochromatic luminescent devices in the OLED display panel may be greater than differences between cathode voltages and anode voltages loaded to the monochromatic luminescent devices in the process of driving the monochromatic luminescent devices to normally emit light. Thus, high current may be produced in the monochromatic luminescent devices of the OLED display panel, so that the monochromatic luminescent devices are driven to emit light and heat, and hence the early stage service life of the monochromatic luminescent devices can be rapidly consumed. In the process of performing lifetime attenuation test on the monochromatic luminescent devices in the OLED display panel after the ageing treatment, the lifetime attenuation rate of the monochromatic luminescent devices under normal luminescent state must be tested, and hence the difference between the cathode voltage and the anode voltage loaded to the monochromatic luminescent devices is the difference between the cathode voltage and the anode voltage loaded to the monochromatic luminescent devices in the process of driving the monochromatic luminescent devices to normally emit light. Therefore, differences between cathode voltages and anode voltages loaded to the monochromatic luminescent devices in the process of performing the ageing treatment on the monochromatic luminescent devices in the OLED display panel are greater than differences between cathode voltages and anode voltages loaded to the monochromatic luminescent devices in the process of performing luminescent lifetime attenuation tests on the monochromatic luminescent devices after the ageing treatment.

In the method provided by the embodiment of the present invention, in the process of performing the ageing treatment on the monochromatic luminescent devices in the OLED display panel, for instance, the cathode voltages loaded to the monochromatic luminescent devices are the same and the anode voltages loaded to the monochromatic luminescent devices are the same. Thus, a voltage is loaded to cathodes and anodes of the monochromatic luminescent devices, so that high current is produced in the monochromatic luminescent devices, and hence the rapid current ageing of the monochromatic luminescent devices can be achieved. As same voltage is loaded to the cathodes of the monochromatic luminescent devices and same voltage is loaded to the anodes of the monochromatic luminescent devices, the monochromatic luminescent devices in the OLED display panel can be conveniently controlled to be processed at the same time, and hence the rapid ageing of the OLED display panel can be conveniently achieved.

Description is given below to the specific implementation of the application of the method provided by the embodiment of the present invention in actual products with reference to a preferred embodiment. The steps thereof are specifically as follows:

1. Inputting a first voltage 0-4V into the monochromatic luminescent devices of the OLED display panel consisting of red, green and blue (RGB) monochromatic luminescent devices in sequence, setting the cathode voltage of the monochromatic luminescent devices to −8V and the anode voltage to 3V, measuring relative brightness attenuation curves of the red, green and blue monochromatic luminescent devices in sequence, and obtaining different luminescent lifetime attenuation rates of the monochromatic luminescent devices.

2. Inputting a second voltage higher than the first voltage (0-4V) into the red, green and blue (RGB) monochromatic luminescent devices respectively, in which the second voltage inputted into red (R) monochromatic luminescent devices is 7.25V; the second voltage inputted into green (G) monochromatic luminescent devices is 8.5V; and the second voltage inputted into blue (B) monochromatic luminescent devices is 7.5V; setting the cathode voltage of the monochromatic luminescent devices to −10V and the anode voltage to 6V; producing high current in the monochromatic luminescent devices; performing current ageing treatments on the monochromatic luminescent devices for 30 min; and subsequently cooling the monochromatic luminescent devices to room temperature.

3. Inputting a first voltage 0-4V into each red, green and blue (RGB) monochromatic luminescent device in sequence, setting the cathode voltage of the monochromatic luminescent devices to −8V and the anode voltage to 3V, and measuring the relative brightness attenuation curves of the red, green and blue (RGB) monochromatic luminescent devices after the ageing treatment in sequence, as a result, the luminescent lifetime attenuation of the monochromatic luminescent devices will become consistent as compared to the luminescent lifetime attenuation before ageing treatment.

4. Determining whether differences between the luminescent lifetime attenuation rates of the monochromatic luminescent devices are greater than the preset threshold compared with the luminescent lifetime attenuation of the monochromatic luminescent devices after the ageing treatment. For instance, the blue (B) monochromatic luminescent devices are subjected to ageing treatments again when the luminescent lifetime attenuation rate of the red (R) monochromatic luminescent devices is determined to be the lowest, the difference between the luminescent lifetime attenuation rate of the red (R) monochromatic luminescent devices and the luminescent lifetime attenuation rate of the blue (B) monochromatic luminescent devices being greater than the preset threshold, the difference between the luminescent lifetime attenuation rate of the red (R) monochromatic luminescent devices and the luminescent lifetime attenuation rate of the green (G) monochromatic luminescent devices being less than the preset threshold. The OLED display panel, in which the luminescent lifetime attenuation of the monochromatic luminescent devices is determined to become consistent when the difference between the luminescent lifetime attenuation rate of the blue (B) monochromatic luminescent devices after second ageing treatment and the luminescent lifetime attenuation rate of the red (R) monochromatic luminescent devices is determined to be less than the preset threshold, can be finally obtained.

Figure 5:
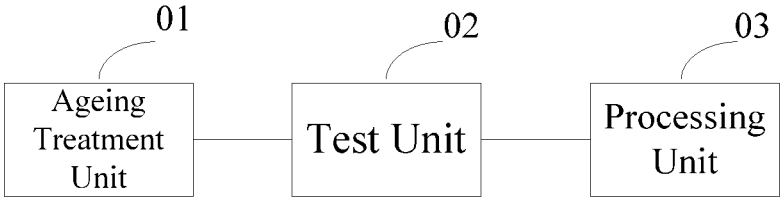
FIG. 5 is a schematic structural view of a device for correcting a color shift of an OLED display panel, provided by one embodiment of the present invention.

Based on the same inventive concept, the embodiment of the present invention further provides a device for correcting a color shift of an OLED display panel. As illustrated in FIG. 5, the device may comprise: an ageing treatment unit 01, a test unit 02 and a processing unit 03.

The ageing treatment unit 01 is configured to perform an ageing treatment on the monochromatic luminescent devices in the OLED display panel. For instance, the ageing treatment unit 01 includes a loading platform, a driving chip, a plurality of pressure terminals, a power supply, etc. The driving chip is connected with the power supply. The pressure terminals are connected with the driving chip and correspond to driving voltage input ends of the OLED display panel to be tested. Driving signals may be applied to the driving chip, so that a preset voltage is outputted to the pressure terminals and hence applied to the monochromatic luminescent devices of the OLED display panel to be tested. The test unit 02 is configured to perform a luminescent lifetime attenuation test on the monochromatic luminescent devices after the ageing treatment respectively and obtain corresponding luminescent lifetime attenuation rates of the monochromatic luminescent devices. For instance, the test unit 02 includes an optical detection apparatus (e.g., a camera) so as to acquire the brightness of the monochromatic luminescent devices, and may also include a memory and/or a computing device (e.g., a central processing unit (CPU)) so as to store and/or compare and calculate the variation of the brightness respectively.

The processing unit 03 is configured to perform ageing treatments on the monochromatic luminescent device with rapidest luminescent lifetime attenuation rate again when the difference between the luminescent lifetime attenuation rates of the monochromatic luminescent devices is greater than a preset threshold, until the difference between the luminescent lifetime attenuation rates of the monochromatic luminescent devices is less than the preset threshold. The processing unit 03, for instance, includes a loading platform, a driving chip, a plurality of pressure terminals, a power supply, etc. The structure of the processing unit 03 may be the same with that of the ageing treatment unit 01, but the voltage applied in the process of operation is different.

In the device for correcting a color shift of the OLED display panel provided by the embodiment of the present invention, the monochromatic luminescent devices in the OLED display panel are subjected to ageing treatments via the ageing treatment unit 01; luminescent lifetime attenuation tests are performed on the monochromatic luminescent devices after the ageing treatment respectively via the test unit 02, and corresponding luminescent lifetime attenuation rates of the monochromatic luminescent devices are obtained; and the monochromatic luminescent devices with rapidest luminescent lifetime attenuation rate are subjected to ageing treatment again via the processing unit 03 when the differences between the luminescent lifetime attenuation rates of the monochromatic luminescent devices are determined to be greater than the preset threshold, until the differences between the luminescent lifetime attenuation rates of the monochromatic luminescent devices are less than the preset threshold. In the OLED display panel processed by the above device, the early stage service life of the monochromatic luminescent devices is rapidly consumed, so that the problem of afterimage of the OLED display panel in the early stage service can be solved. Meanwhile, the lifetime attenuation rates of the processed monochromatic luminescent devices are moderate and become consistent. Therefore, when the OLED display panel is applied in corresponding OLED display product, as the lifetime attenuation rates of the monochromatic luminescent devices become consistent, the relative brightness of the monochromatic luminescent devices becomes consistent along with the rise of the use time, and hence the color shift phenomenon of display images of the OLED display product after long-term use can be effectively avoided.

In the device provided by the embodiment of the present invention, the ageing treatment unit 01 is configured to input different preset voltages into the monochromatic luminescent devices in the OLED display panel respectively, and allow the monochromatic luminescent devices to emit light for a preset duration and subsequently be cooled to room temperature. The preset voltage is determined by materials of emitting layers of the monochromatic luminescent devices. That is to say, the preset voltage for the ageing treatment of the monochromatic luminescent devices is determined by the materials of the emitting layers of the monochromatic luminescent devices; corresponding preset voltage is inputted; and the monochromatic luminescent devices in the OLED display panel are subjected to ageing treatment via the ageing treatment unit 01.

In the device provided by the embodiment of the present invention, the test unit 02 is configured to input voltage for luminescent lifetime attenuation tests into the monochromatic luminescent devices after the ageing treatment in sequence, allow the monochromatic luminescent devices to emit light for a preset duration, and obtain a corresponding luminescent lifetime attenuation curve of the monochromatic luminescent devices. The process of performing a luminescent lifetime attenuation test on the monochromatic luminescent devices via the test unit 02 in sequence and obtaining the luminescent lifetime attenuation rate of the monochromatic luminescent devices provides a determinant condition for determining whether the luminescent lifetime attenuation of the monochromatic luminescent devices in the OLED display panel after the ageing treatment become consistent.

In the device provided by the embodiment of the present invention, as the monochromatic luminescent devices in the OLED display panel must be subjected to rapid ageing to consume the early stage service life of the monochromatic luminescent devices, the preset voltage inputted in the process of performing the ageing treatment on the monochromatic luminescent devices in the OLED display panel via the ageing treatment unit 01 is greater than the voltage inputted in the process of performing luminescent lifetime attenuation test on the monochromatic luminescent devices after the ageing treatment via the test unit 02. Thus, high current higher than the current for driving the monochromatic luminescent devices to normally emit light may be produced in the monochromatic luminescent devices, so that the monochromatic luminescent devices are driven to emit light and heat. Therefore, the lifetime of the monochromatic luminescent devices can be rapidly consumed, and hence the rapid ageing treatment of the monochromatic luminescent devices can be achieved.

In the device provided by the embodiment of the present invention, in order to consume the early stage service life of the monochromatic luminescent devices by the rapid ageing of the monochromatic luminescent devices in the OLED display panel, a difference between a cathode voltage and an anode voltage loaded to the monochromatic luminescent devices by the ageing treatment unit 01 in the process of performing the ageing treatment on the monochromatic luminescent devices in the OLED display panel is greater than a difference between a cathode voltage and an anode voltage loaded to the monochromatic luminescent devices by the test unit 02 in the process of performing luminescent lifetime attenuation test on the monochromatic luminescent devices after the ageing treatment. Thus, high current higher than the current for driving the monochromatic luminescent devices to normally emit light may be produced in the monochromatic luminescent devices, so that the monochromatic luminescent devices are driven to emit light and heat. Therefore, the lifetime of the monochromatic luminescent devices can be rapidly consumed, and hence the rapid ageing treatment of the monochromatic luminescent devices can be achieved.

In the device provided by the embodiment of the present invention, in the process of performing the ageing treatment on the monochromatic luminescent devices in the OLED display panel, the cathode voltage loaded to the monochromatic luminescent devices by the ageing treatment unit 01 is same and the anode voltage loaded to the monochromatic luminescent devices is same. Thus, voltage is loaded to cathodes and anodes of the monochromatic luminescent devices, so that high current is produced in the monochromatic luminescent devices, and hence the rapid current ageing of the monochromatic luminescent devices can be achieved. As same voltage is loaded to the cathodes of the monochromatic luminescent devices and same voltage is loaded to the anodes of the monochromatic luminescent devices, the ageing treatment of the monochromatic luminescent devices in the OLED display panel can be conveniently achieved at the same time, and hence the rapid ageing treatment of the OLED display panel can be achieved.

In the device provided by the embodiment of the present invention, in the process of performing ageing treatment by inputting preset voltage into the monochromatic luminescent devices in the OLED display panel via the ageing treatment unit 01, for instance, the preset duration of the light emitting of the monochromatic luminescent devices may be set to be same, so that the ageing treatment can be conveniently performed on the monochromatic luminescent devices in the OLED display panel at the same time, and hence the rapid ageing treatment of the OLED display panel can be achieved.

On the basis of the same inventive concept, the embodiment of the present invention provides an OLED display device, which comprises the OLED display panel processed by the method for correcting the color shift of the OLED display panel, provided by the embodiment of the present invention. The display device may be applied in any product or component with display function such as a mobile phone, a tablet PC, a TV, a display, a notebook computer, a digital picture frame and a navigator. As the principle of the display device for solving the problem is similar to that of the OLED display panel processed by the method for correcting the color shift of the OLED display panel, provided by the embodiment of the present invention, the embodiments of the display device may refer to the embodiments of the OLED display panel processed by the method for correcting the color shift of the OLED display panel, provided by the embodiment of the present invention. No further description will be given here.

In the method and device for correcting the color shift of the OLED display panel, and the display device, provided by the embodiment of the present invention, the monochromatic luminescent devices in the OLED display panel are subjected to ageing treatment; luminescent lifetime attenuation test is performed on the monochromatic luminescent devices after the ageing treatment respectively, and corresponding luminescent lifetime attenuation rates of the monochromatic luminescent devices are obtained; and the monochromatic luminescent devices with rapidest luminescent lifetime attenuation rate are subjected to ageing treatment again when the differences between the luminescent lifetime attenuation rates of the monochromatic luminescent devices are greater than the preset threshold, until the differences between the luminescent lifetime attenuation rates of the monochromatic luminescent devices are less than the preset threshold. In the OLED display panel processed by the processing method, as the early stage service life of the monochromatic luminescent devices is rapidly consumed, the problem of afterimage of the OLED display panel in the early stage service is solved. Meanwhile, the lifetime attenuation rate of the processed monochromatic luminescent devices is moderate and becomes consistent. Therefore, when the OLED display panel is applied in corresponding OLED display product, as the lifetime attenuation rate of the monochromatic luminescent devices becomes consistent, the relative brightness of the monochromatic luminescent devices becomes consistent along with the rise of the use time, and hence the color shift phenomenon of display images of the OLED display product after long-term use can be effectively avoided.

The foregoing is only the preferred embodiments of the present invention and not intended to limit the scope of protection of the present invention. The scope of protection of the present invention should be defined by the appended claims.

The application claims priority to the Chinese patent application No. 201510020929.5, filed on Jan. 15, 2015, the disclosure of which is incorporated herein by reference as part of the application.

What is claimed is:

1. A method for correcting a color shift of an organic light-emitting diode (OLED) display panel, comprising:

performing an ageing treatment on monochromatic luminescent devices in the OLED display panel;

performing a luminescent lifetime attenuation test on the monochromatic luminescent devices after the ageing treatment respectively, and obtaining corresponding luminescent lifetime attenuation rates of the monochromatic luminescent devices; and performing an ageing treatment on the monochromatic luminescent device with rapidest luminescent lifetime attenuation rate again when differences between the luminescent lifetime attenuation rates of the monochromatic luminescent devices are greater than a preset threshold, until differences between the luminescent lifetime attenuation rates of the monochromatic luminescent devices are less than the preset threshold.

2. The method according to claim 1, wherein performing of the ageing treatment on the monochromatic luminescent devices in the OLED display panel includes:

inputting a different preset voltage into the monochromatic luminescent devices in the OLED display panel respectively, and allowing the monochromatic luminescent devices to emit light for a preset duration and subsequently cooled to room temperature, in which the preset voltage is determined by a material of an emitting layer of the monochromatic luminescent devices.

3. The method according to claim 2, wherein in the process of performing the ageing treatment by inputting a preset voltage into the monochromatic luminescent devices in the OLED display panel, the preset durations of light emitting of the monochromatic luminescent devices are the same.

4. An organic light-emitting diode (OLED) display device, comprising the OLED display panel processed by the method according to claim 2.

5. The method according to claim 2, wherein performing of the luminescent lifetime attenuation test on the monochromatic luminescent devices after the ageing treatment respectively includes:

inputting a voltage for the luminescent lifetime attenuation test into the monochromatic luminescent devices after the ageing treatment respectively, allowing the monochromatic luminescent devices to emit light for a preset duration, and obtaining a corresponding luminescent lifetime attenuation curve of the monochromatic luminescent devices.

6. The method according to claim 5, wherein in the process of performing the ageing treatment by inputting a preset voltage into the monochromatic luminescent devices in the OLED display panel, the preset durations of light emitting of the monochromatic luminescent devices are the same.

7. The method according to claim 5, wherein the preset voltage inputted in the process of performing the ageing treatment on the monochromatic luminescent devices in the OLED display panel is greater than the voltage inputted in the process of performing the luminescent lifetime attenuation test on the monochromatic luminescent devices after the ageing treatment.

8. The method according to claim 7, wherein a difference between a cathode voltage and an anode voltage loaded to the monochromatic luminescent devices in the process of performing the ageing treatment on the monochromatic luminescent devices in the OLED display panel is greater than a difference between a cathode voltage and an anode voltage loaded to the monochromatic luminescent devices in the process of performing the luminescent lifetime attenuation test on the monochromatic luminescent devices after the ageing treatment.

9. The method according to claim 8, wherein in the process of performing the ageing treatment on the monochromatic luminescent devices in the OLED display panel, the cathode voltages loaded to the monochromatic luminescent devices are the same and the anode voltages loaded to the monochromatic luminescent devices are the same.

10. An organic light-emitting diode (OLED) display device, comprising the OLED display panel processed by the method according to claim 1.

11. The method according to claim 1, wherein performing of the luminescent lifetime attenuation test on the monochromatic luminescent devices after the ageing treatment respectively includes:

inputting a voltage for the luminescent lifetime attenuation test into the monochromatic luminescent devices after the ageing treatment respectively, allowing the monochromatic luminescent devices to emit light for a preset duration, and obtaining a corresponding luminescent lifetime attenuation curve of the monochromatic luminescent devices.

12. A device for correcting a color shift of an organic light-emitting diode (OLED) display panel, comprising: an ageing treatment unit, a test unit and a processing unit, in which the ageing treatment unit is configured to perform an ageing treats treatment on the monochromatic luminescent devices in the OLED display panel;

the test unit is configured to perform a luminescent lifetime attenuation test on monochromatic luminescent devices after the ageing treatment, and obtain corresponding luminescent lifetime attenuation rates of the monochromatic luminescent devices; and the processing unit is configured to perform an ageing treatment on the monochromatic luminescent device with rapidest luminescent lifetime attenuation rate again when differences between the luminescent lifetime attenuation rates of the monochromatic luminescent devices are greater than a preset threshold, until the differences between the luminescent lifetime attenuation rates of the monochromatic luminescent devices are less than the preset threshold.

13. The device according to claim 12, wherein the ageing treatment unit is configured to input a different preset voltage into the monochromatic luminescent devices in the OLED display panel respectively, and allow the monochromatic luminescent devices to emit light for a preset duration and subsequently cooled to room temperature, in which the preset voltage is determined by a material of an emitting layer of the monochromatic luminescent devices.

14. The device according to claim 13, wherein the ageing treatment unit is configured as: in the process of performing the ageing treatment by inputting the preset voltages into the monochromatic luminescent devices in the OLED display panel, the preset durations of light emitting of all the monochromatic luminescent devices are the same.

15. The device according to claim 13, wherein the test unit is configured to input a voltage for the luminescent lifetime attenuation test into the monochromatic luminescent devices after the ageing treatment respectively, allow the monochromatic luminescent devices to emit light for a preset duration, and obtain a corresponding luminescent lifetime attenuation curve of the monochromatic luminescent devices.

16. The device according to claim 15, wherein the ageing treatment unit is configured as: in the process of performing the ageing treatment by inputting the preset voltages into the monochromatic luminescent devices hi the OLEO display panel, the preset durations of light emitting of all the monochromatic luminescent devices are the same.

17. The device according to claim 15, wherein the ageing treatment unit is configured as: the preset voltage inputted in the process of performing the ageing treatment on the monochromatic luminescent devices in the OLED display panel is greater than the voltage inputted in the process of performing the luminescent lifetime attenuation test on the monochromatic luminescent devices after the ageing treatment.

18. The device according to claim 17, wherein the ageing treatment unit is configured as: in the process of performing the ageing treatment by inputting the preset voltages into the monochromatic luminescent devices in the OLED display panel, the preset durations of light emitting of all the monochromatic luminescent devices are the same.

19. The device according to claim 17, wherein the ageing treatment unit is configured as: a difference between a cathode voltage and an anode voltage loaded to the monochromatic luminescent devices in the process of performing the ageing treatment on the monochromatic luminescent devices in the OLED display panel is greater than a difference between a cathode voltage and an anode voltage loaded to the monochromatic luminescent devices in the process of performing a luminescent lifetime attenuation test on the monochromatic luminescent devices after the ageing treatment.

20. The device according to claim 19, wherein the ageing treatment unit is configured as: in the process of performing the ageing treatment on the monochromatic luminescent devices in the OLED display panel, the cathode voltages loaded to all the monochromatic luminescent devices are the same and the anode voltages loaded to all the monochromatic luminescent devices are the same.

* * * * *